US006725795B2

(12) United States Patent
Gonzalez

(10) Patent No.: US 6,725,795 B2
(45) Date of Patent: Apr. 27, 2004

(54) SEWING MACHINE SEAM ADJUSTMENT DEVICE

(76) Inventor: Felix Gonzalez, P.O. Box 221072, Salt Lake City, UT (US) 84122

( * ) Notice: Subject to any disclaimer, the term of this patent is extended or adjusted under 35 U.S.C. 154(b) by 209 days.

(21) Appl. No.: 10/040,088

(22) Filed: Jan. 4, 2002

(65) Prior Publication Data

US 2003/0127031 A1 Jul. 10, 2003

(51) Int. Cl.[7] ..... D05B 19/12; D05B 35/10
(52) U.S. Cl. ..... 112/470.07; 112/235; 112/153
(58) Field of Search ..... 112/470.07, 306, 112/153, 63, 235, 240, 236, 237, 238, 239

(56) References Cited

U.S. PATENT DOCUMENTS 3,511,199 A * 5/1970 Howell ..... 112/235
4,018,174 A * 4/1977 DiBenedetto et al. ..... 112/235
4,411,211 A * 10/1983 Heimberger ..... 112/235 X
4,648,337 A * 3/1987 Mall ..... 112/153
4,883,005 A * 11/1989 Wehmeyer ..... 112/153 X
4,967,674 A * 11/1990 Rohr et al. ..... 112/63
5,603,271 A * 2/1997 Reinhart et al. ..... 112/153

* cited by examiner

*Primary Examiner*—Peter Nerbun
(74) *Attorney, Agent, or Firm*—TraskBritt

(57) ABSTRACT

An improved sewing machine is disclosed for making consistent edge seams. The improvement automatically adjusts a width of a sewn seam based upon feedback from a sensor which detects a position of a sewn edge. Feedback from the sensor causes a transverse adjustment in the position of an edge guide. An outside foot of the sewing machine may be suspended on a biased linkage to permit its transverse displacement when making an adjustment to a seam width.

15 Claims, 5 Drawing Sheets

SEWING MACHINE SEAM ADJUSTMENT DEVICE

TECHNICAL FIELD

This invention relates generally to sewing machines, and, more specifically, to sewing machines having apparatus to ensure a seam is sewn having a correct width.

BACKGROUND

Sewing machines wherein the instant invention finds exemplary application include industrial sewing machines used to form edge seams. Such machines may incorporate a feedback sensor to ensure proper positioning of material being sewn. A light-based sensor arrangement used in certain commercial sewing machines has a light sensor that is positionable to track a location of an edge of material while the material is being sewn. The sensor can be adjusted to trigger when the sewn seam becomes too wide, occluding the sensor beam. When such a condition occurs, the sensor triggers to turn off the sewing machine. Unfortunately, however, the momentum of the sewing machine causes additional stitches to be sewn in the material before the needle can be brought to a halt. Consequently, from about one to perhaps several inches of noncompliant seam will be sewn as the machine slows down. Generally, the noncompliant portion of the seam must, at a minimum, be picked apart for re-stitching at a correct width. The entire seam may need to be undone, and the seam started from a beginning, for aesthetic or other reasons. In some cases, the noncompliant seam may ruin the article in which the seam is being sewn, causing the article to be scrapped.

Certain available sewing machines have an edge guide to space a sewing machine needle from a material's sewn edge. Such guides are adjustable mechanically, for example, by turning a threaded shaft, but such adjustment is limited to an initial set-up for seam size. A seam may be sewn by an operator with such a machine by pressing material into engagement with the guide surface simultaneously with pushing slightly in a direction to feed material into the machine needle. No adjustability in guide location is contemplated when a seam is being sewn.

SUMMARY OF THE INVENTION

The invention provides a device automatically to adjust a seam size while sewing the seam in a sewing machine. The invention can be embodied as a clamping foot for a sewing machine. The clamping foot includes an inside foot adapted for attachment to the sewing machine, and an outside foot suspended in transversely adjustable relation from the inside foot. A biasing element is typically arranged to bias the outside foot in an outside direction from the inside foot. The clamping foot may be used in combination with an edge guide operable to assist in feeding material into sewing engagement with a sewing machine on which the clamping foot is attached. Usually, a transducer is affixed between the sewing machine and the edge guide. The transducer transversely displaces the edge guide to control a seam size. A sensor is positioned to validate a seam size and provide a signal in a feedback loop to control the transducer. A stop mechanism may be used to limit a maximum transverse displacement of the outside foot in an inside direction.

These features, advantages, and alternative aspects of the present invention will be apparent to those skilled in the art from a consideration of the following detailed description taken in combination with the accompanying drawings.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

Reference will now be made to the drawings in which the various elements of the invention will be given numerical designations and in which the invention will be discussed so as to enable one skilled in the art to make and use the invention. It is to be understood that the following description is only exemplary of the principles of the present invention, and should not be viewed as narrowing the claims which follow.

The invention relates to sewing seams in material. The invention will typically be described from the reference point of material being sewn. That is, directions are described from the material's perspective. An outside direction may be characterized by a vector pointing from the material toward an edge, typically the edge being sewn. Similarly, an inside direction may be characterized by a vector oppositely directed from an outside direction. Outboard, or outside, are typically used as relative locations and may indicate being located away from the material, or simply more toward such location than a reference location. A seam size is defined as the distance from a closest edge of the material to the stitches forming the seam.

Figure 1:
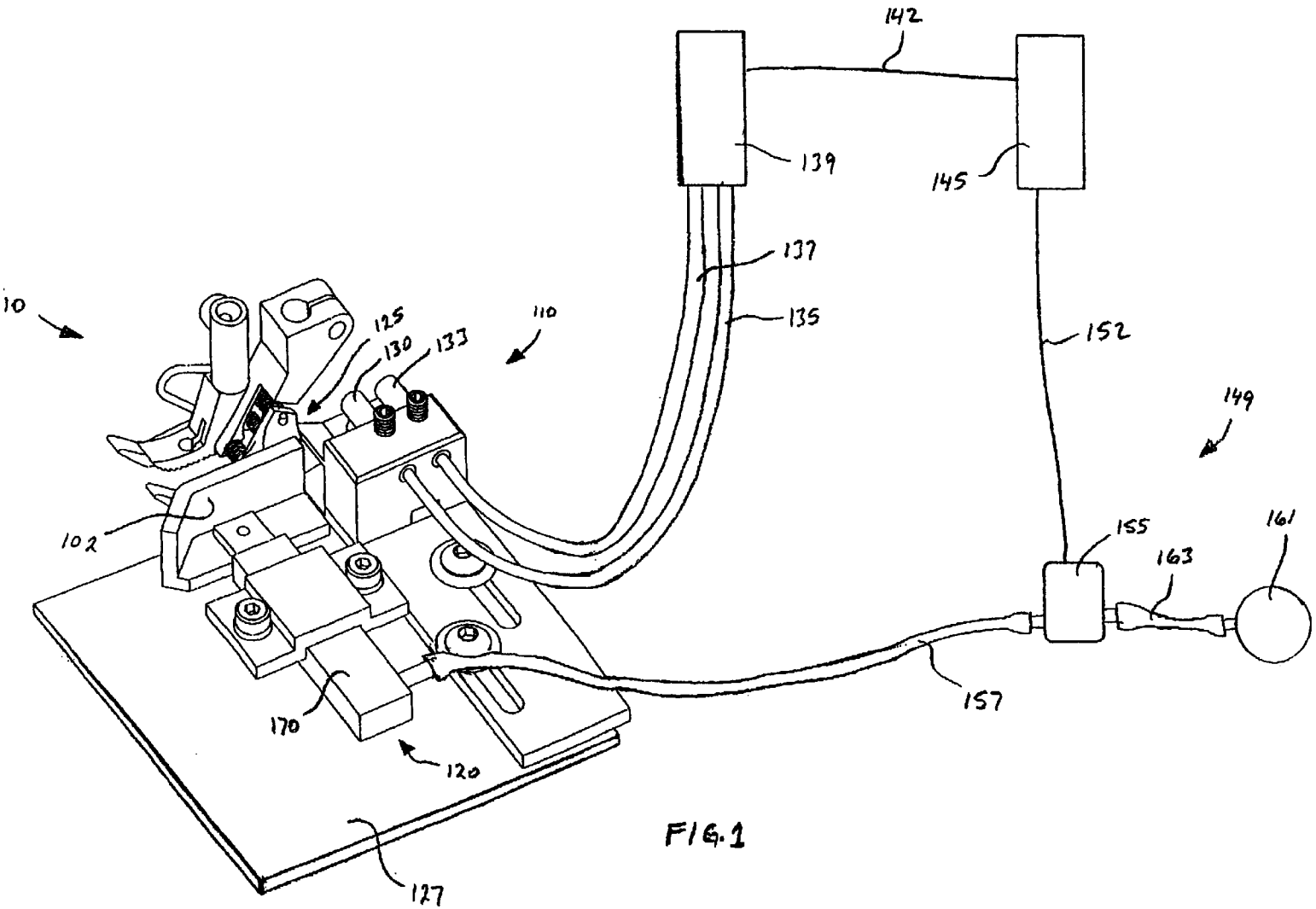
FIG. 1 is a front and side view in perspective, from an above and outside position, of an embodiment according to the invention.
Figure 2:
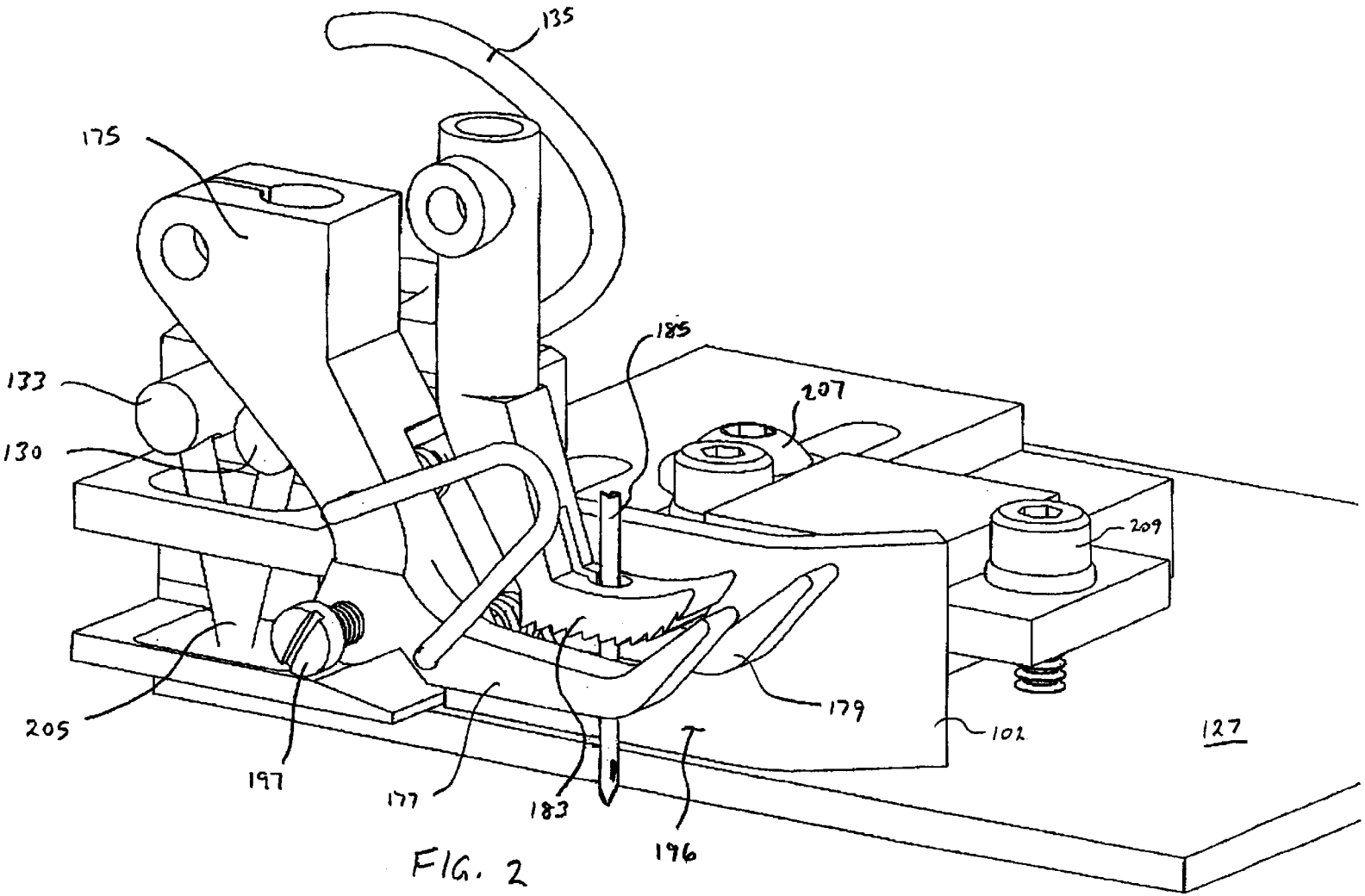
FIG. 2 is a front and side view in perspective, from an above and inside position, of a portion of the embodiment of FIG. 1.
Figure 3:
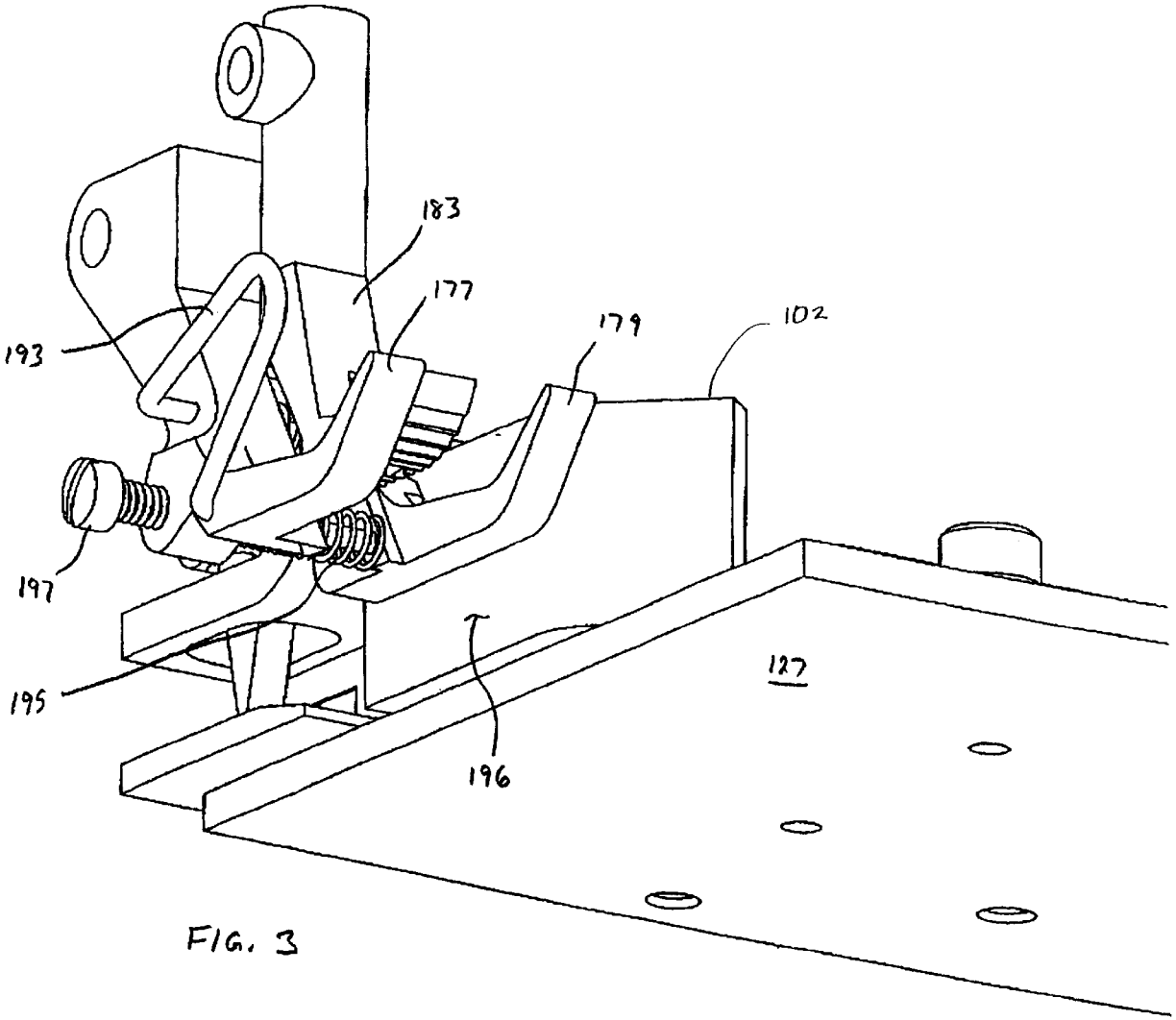
FIG. 3 is a perspective view, from a below and inside position, of the embodiment of FIG. 2.

The principal working components of a currently preferred embodiment of the invention, generally indicated at 10, are illustrated in FIG. 1. The seam adjustment device 10 includes an edge guide 102, a sensor, generally indicated at 110, and a displacement transducer, generally indicated at 120. A seam adjuster 10 also desirably includes an outside foot, generally indicated at 125, adapted to accommodate a transverse displacement. Certain of these components can conveniently be carried on a slide plate 127 for installation on a commercial sewing machine.

Edge guide 102 can function as a brace element against which material to be sewn is placed by a sewing machine operator. Typically, a small amount of outwardly directed pressure is exerted by the operator on the material to maintain the material against the edge guide 102. As the material is sewn, the seamed edge passes past sensor 110 which validates the correct seam size. Edge guide 102 may be transversely located to position the guide surface a desired distance transverse and outboard to a sewing needle and at the correct distance to form a desired seam size. The edge guide 102 is configured and arranged for its position, relative to a sewing needle, to be adjusted by transducer 120. Automated adjustment of a position of the edge guide 102 is controlled by a feedback loop based upon seam size.

Illustrated sensor 110 includes light-based sending unit 130 and a light receiving unit 133. As illustrated, light carried by pipe 135 passes through sending unit 130, is scattered, refracted, and reflected, with a portion being subsequently received by receiving unit 133. The return signal from unit 133 is carried by light pipe 137 and is used to operate switch 139.

When the sewn edge is in compliance for size, switch 139 is typically in an open configuration. When the seam goes out of compliance, because sensor 110 indicates the seam is too wide, switch 139 closes, and sends an adjustment signal through cable 142 to adjust the seam width. Cable 142 may carry the adjustment signal to a power supply 145 to boost the signal subsequently sent to a control switch, generally indicated at 149. However, the boost from a power supply 145 may not be required in certain embodiments of a seam adjuster 10. In the latter case, the signal may be sent from switch 139 directly to operate a transducer to adjust seam size.

As illustrated in FIG. 1, the boosted signal is transmitted from power supply 145 through cable 152 to operate valve 155. When valve 155 is opened, a fluid is permitted to flow through line 157 and operate displacement transducer 120. Fluid is typically supplied from a fluid source 161 and brought to a convenient location on, or near, a sewing machine through supply line 163. A currently preferred fluid is compressed air, although hydraulic fluids are also operable. The illustrated displacement transducer 120 is an air driven piston 170. The invention is not limited to use of such piston type displacement transducers. Alternative transducers within contemplation to adjust a position of edge guide 102 nonexclusively include individually or in combination: linear motors, rack and gear linkages, single and multibar linkages, cams, cams and followers, DC motors, stepper motors, and any other workable arrangement to convert some form of energy into a transverse displacement of the edge guide 102.

FIGS. 2–5 illustrate certain operational details of the invention. A stationary clamping foot 175 of a commercially available sewing machine is modified to have an independent inside foot 177 and an outside foot 179. In accordance with conventional sewing machines, stationary foot 175 operates to hold the material being sewn in clamped engagement with the slide plate 127. Walking foot 183, in combination with a feed mechanism located under the material (not shown), operates to feed material past needle 185 for stitching.

Figure 4:
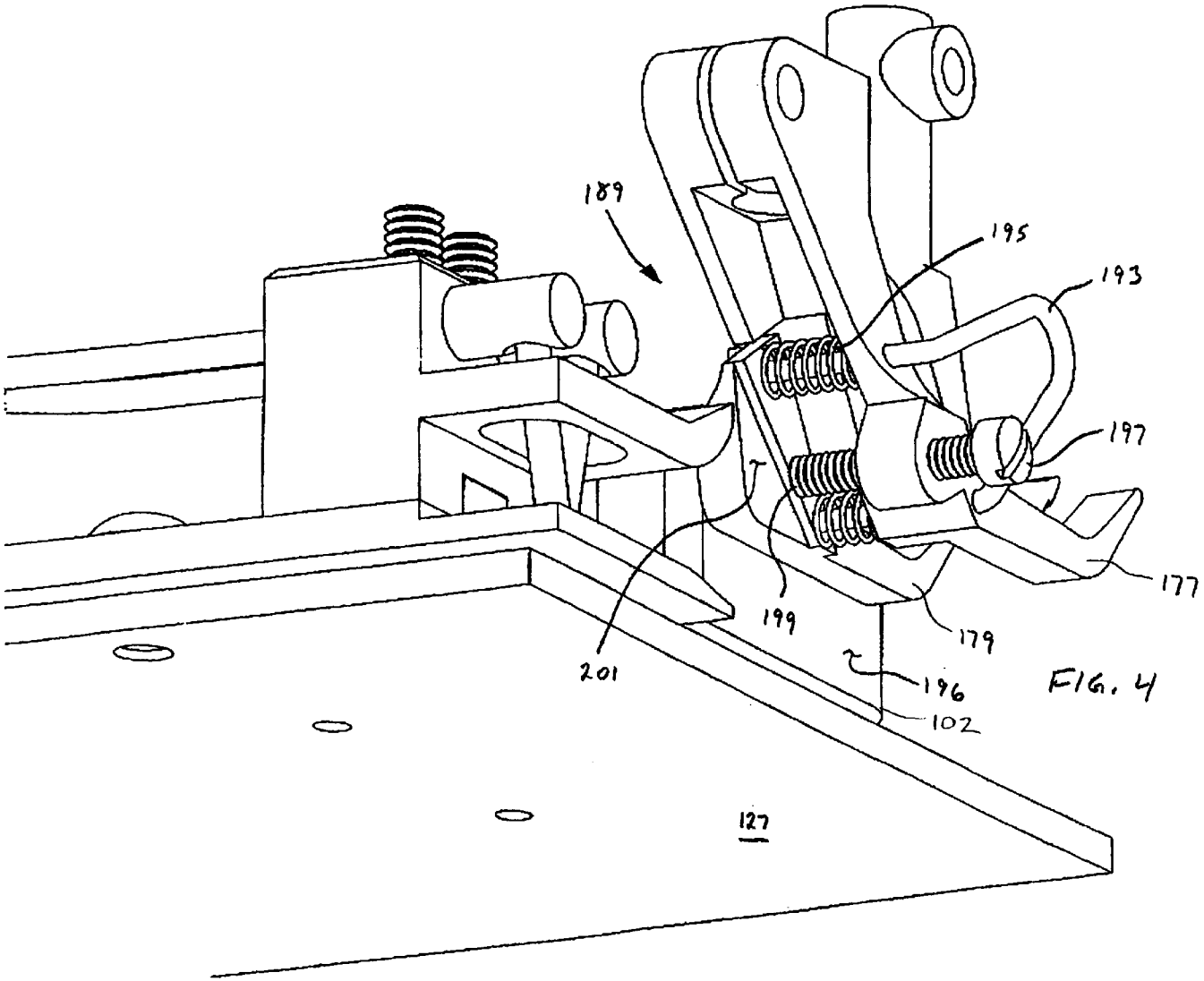
FIG. 4 is a rear and side view in perspective, from a below and inside position, of the embodiment of FIG. 2.

With reference now to FIG. 4, outside foot 179 desirably is adapted for transverse displacement toward and away from needle 185. One way to accommodate such transverse motion is achieved by suspending outside foot 179 from inside foot 177 with a suspension mechanism, generally indicated at 189. Alternatively, an outside foot 179 may be suspended from other portions of a sewing machine. As illustrated, suspension mechanism 189 includes a rail 193 which is arranged in sliding capture through inside foot 177. Rail 193 can be adapted, as illustrated, to form a forward protruding lever portion to assist in positioning an outside foot 179. Other conformations of suspension systems are within contemplation, nonexclusively including sliding journalled elements, dovetail joints, pivoting rods, and multibar linkages.

One or more biasing elements, such as spring 195, are typically included to bias outside foot 179 in an outboard direction. Outside foot 179 may then be placed into engagement with surface 196 of edge guide 102 when adjusting a sewing machine to sew a given seam size. However, outside foot 179 does not necessarily have to be in engagement with surface 196 for the invention to be operable. Outside foot 179 functions to maintain material in a substantially flat orientation between edge guide 102 and a needle 185. A transverse displacement of edge guide 102 therefore moves the material by a corresponding amount to adjust a seam size. It is within contemplation for outside foot 179 to be replaceable with alternative outside feet which are either wider or more narrow than illustrated. Wide feet 179 may be more appropriate when sewing wide seams, and narrow feet 179 may be more appropriate when sewing narrow seams.

A stop mechanism, such as screw 197, may be arranged to limit a transverse displacement of outside foot 179 in an inside direction. As illustrated, end 199 of screw 197 is spaced apart from inside surface 201 of outside foot 179. Stop mechanism 197 desirably is adjustable to provide a range in maximum inward displacement values for outside foot 179.

Figure 5:
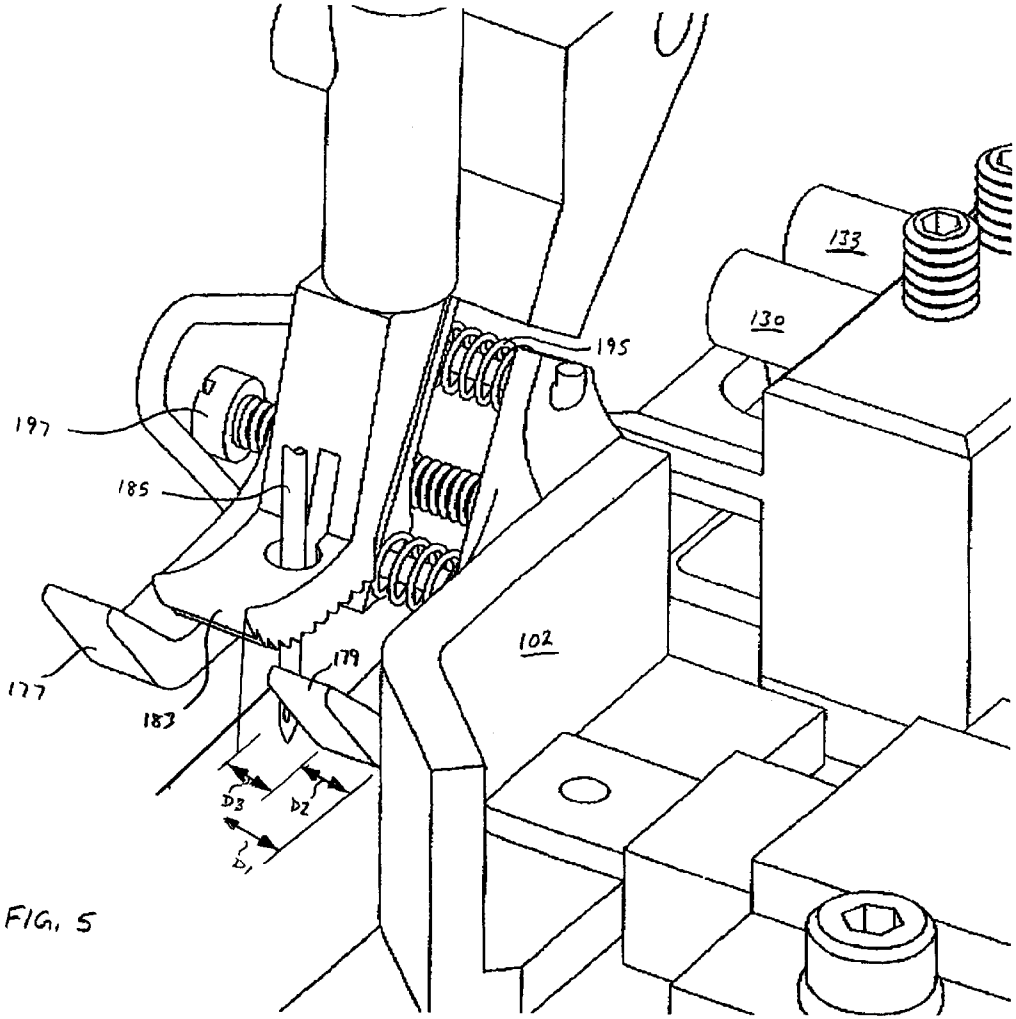
FIG. 5 is a close-up front and side view in perspective, from an above and outside position, of a portion of the embodiment in FIG. 1.

FIG. 5 illustrates certain distance relationships in one embodiment of the invention. When setting up a sewing machine to sew a seam, edge guide 102 is positioned at a distance D1 from a centerline of needle 185. D1 therefore corresponds to the seam size. Outside foot 179 has a width D2, leaving a space between it and walking foot 183 indicated by D3. Stop 197 is set to limit displacement of outside foot 179, by a distance less than D3, to prevent contact between outside foot 179 and walking foot 183. Typically, stop 197 is set to limit an inward displacement of edge guide 102 to a minimum value determined to be sufficient to make a seam size correction, "steering" the material back into seam size compliance. Such "steering" displacement is typically less than the distance indicated by D3. Factors affecting a steering displacement include the material type, thickness, weight, and texture. A steering displacement may be generally set at a certain percentage of a seam size. A steering displacement may also be determined by a maximum amount of travel permitted by the displacement stroke of an edge guide 102. A transducer 120 may be provided having an adjustable stroke, or a stop mechanism may be set to operate on the edge guide 102 directly.

The position of a sensor 110 is desirably adjustable to locate the sensing zone 205 at a distance transverse to a sewing machine needle 185 corresponding to the desired seam size. As with the edge guide 102, a component's position may be maintained by tightening bolts 207 or 209 subsequent to moving the component into its desired position. A position may be measured relative to a sewing needle 185 by use of a tape measure, or other measuring device. It is also within contemplation for a vernier scale to be incorporated into a slide plate 127 to assist in adjusting a sewing machine for a desired seam size. Other calibrated mechanisms to adjust an edge guide or sensor 110 to a position may include rotating dials or mechanisms adapted to provide audible or mechanical feedback (e.g., "click") at discrete intervals.

It is preferable for the sensing zone 205 of a sensor 110 to be positioned in stitched proximity and fairly close to the needle 185. That is, the sensor 110 is usually positioned to observe (for feedback) a portion of material in which a seam has just been stitched. A close location to the needle 185 provides feedback of seam size in time to effect a correction in such size before creating scrap, or requiring shutdown of the sewing machine.

It is within contemplation to use alternative sensor arrangements, other than illustrated in the figures, for seam size feedback. For example, a single light-based sensor may be self-contained to provide both sending and receiving functions. Other alternative sensors within contemplation include capacitive sensors, direct displacement transducers, other laser or LED-based sensors, sensing arrays, or any other sensor capable of indicating the location of an edge of sewn material. A pair of sensors may be used in harmony, with one sensor observing the stitches, and another simultaneously observing the finished edge to create a pair of signals having information with which a seam size may be calculated, and the information used in a feedback loop. A proportional control and feedback also can be employed to operate the invention. In such a case, larger displacement is applied in correspondence with an increased error in seam size.

While the invention has been described in particular with reference to certain illustrated embodiments, such is not intended to limit the scope of the invention. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A sewing machine for sewing edge seams, comprising:

an edge guide operatively associated with a displacement transducer configured and arranged to move said edge guide in a direction generally transverse to an edge of a sewing seam transversely to displace material being sewn and thereby adjust a size of said sewing seam;

a sensor operable to detect an edge position of material subsequent to said material being sewn;

wherein:

a signal from said sensor is incorporated in a feedback loop to operate said transducer for purposes of seam size control; and an outside foot disposed in operable association with said edge guide and adapted for displacement in a direction generally transverse to a sewing direction, said outside foot being operable to maintain material in transversely adjustable engagement with a sewing machine surface.

2. The sewing machine of claim 1, further comprising a linkage system suspending said outside foot from an inside foot.

3. The sewing machine of claim 2, further comprising a resilient member adapted to bias said outside foot toward an outside position.

4. The sewing machine of claim 3, further comprising:

a displacement stop mechanism adapted to limit displacement of said outside foot in an inside direction.

5. The sewing machine of claim 4, wherein said displacement stop mechanism is adjustable to provide a range in maximum inside displaced positions of said outside foot.

6. The sewing machine of claim 5, wherein said transducer is adapted, upon receiving a signal from said sensor, to displace said outside foot from an outside position to a said maximum inside position, thereby to reduce a size of said seam.

7. The sewing machine of claim 5, wherein an outside edge of said outside foot is adapted to occupy a biased position in contact with a guide surface of said edge guide to assist in maintaining said material in contact with said guide surface.

8. The sewing machine of claim 5, wherein said outside foot has a width in a transverse direction, said width being less than a seam size, said outside foot being operable to contact a perimeter of said material so as to resist folding of said perimeter during a transverse adjustment in seam width.

9. The sewing machine of claim 8, in combination with a plurality of interchangeable outside feet having different width.

10. A seam width adjustment mechanism for a sewing machine, comprising:

a sensor to locate an edge in stitched proximity to a sewing needle, said needle being installed for sewing operation by said sewing machine;

an adjustably positionable edge guide in substantially transverse proximity and outside said needle with respect to a seam, said edge guide being operable to facilitate feeding of material toward said needle for sewing said seam;

a displacement transducer operable to adjust a transverse position of said edge guide as a function of a signal from said sensor;

a stop mechanism to limit a transverse displacement imparted by said transducer to said edge guide; and an outside foot carried by a linkage system having a foundation on structure of said sewing machine, said outside foot being biased toward an outside position by a resilient element.

11. The seam width adjustment mechanism of claim 10, said outside foot being adapted to follow an inside surface of said edge guide for mutual transverse displacement by said transducer.

12. The seam width adjustment mechanism of claim 11, said stop mechanism comprising a structure adjustably positionable to limit an inward displacement of said outside foot.

13. A clamping foot in combination with an edge guide for a sewing machine, comprising:

an inside foot adapted for attachment to said sewing machine;

an outside foot suspended in transversely adjustable relation from said inside foot; and a biasing element arranged to bias said outside foot in an outside direction;

an edge guide operable to assist in feeding material into sewing engagement with a sewing machine on which said clamping foot is attached; and a transducer affixed between said sewing machine and said edge guide, said transducer being operable transversely to displace said edge guide to control a seam size while said seam is being sewn.

14. The clamping foot in combination according to claim 13, further comprising:

a sensor positioned to validate a seam size and provide a signal in a feedback loop to control said transducer.

15. The clamping foot in combination according to claim 14, further comprising:

a stop mechanism configured and arranged operatively to limit a maximum transverse displacement of said outside foot in an inside direction.

* * * * *